US008063728B2

(12) United States Patent
Brunel et al.

(10) Patent No.: US 8,063,728 B2
(45) Date of Patent: Nov. 22, 2011

(54) INDUCTIVE COMPONENT FOR HIGH CURRENTS AND METHOD FOR THE PRODUCTION THEREOF

(75) Inventors: Roman Brunel, Ulm (DE); Josef Feth, Heidenheim (DE); Gerd Riedel, Heidenheim (DE)

(73) Assignee: EPCOS AG, Munich (DE)

( * ) Notice: Subject to any disclaimer, the term of this patent is extended or adjusted under 35 U.S.C. 154(b) by 119 days.

(21) Appl. No.: 11/573,616

(22) PCT Filed: Aug. 11, 2005

(86) PCT No.: PCT/DE2005/001422

§ 371 (c)(1),
(2), (4) Date: Jun. 1, 2007

(87) PCT Pub. No.: WO2006/015589

PCT Pub. Date: Feb. 16, 2006

(65) Prior Publication Data

US 2008/0012675 A1 Jan. 17, 2008

(30) Foreign Application Priority Data

Aug. 12, 2004 (DE) ..... 10 2004 039 230

(51) Int. Cl.

| | |
|---|---|
| ***H01F 27/02*** | (2006.01) |
| ***H01F 5/00*** | (2006.01) |
| ***H01F 27/24*** | (2006.01) |
| ***H01F 27/28*** | (2006.01) |
| ***H01F 7/06*** | (2006.01) |

(52) U.S. Cl. ..... 336/92; 336/83; 336/200; 336/212; 336/232; 29/602.1

(58) Field of Classification Search ..... 336/83, 336/200, 232, 92, 212; 29/602.1
See application file for complete search history.

(56) References Cited

U.S. PATENT DOCUMENTS

| | | | | |
|---|---|---|---|---|
| 2,947,960 | A | 8/1960 | Fredrickson | |
| 3,209,294 | A * | 9/1965 | Cornell | 336/134 |
| 3,321,725 | A | 5/1967 | Canney | |
| 4,769,900 | A * | 9/1988 | Morinaga et al. | 29/606 |
| 5,169,099 | A * | 12/1992 | Yang | 248/49 |
| 5,393,934 | A * | 2/1995 | Mori et al. | 174/257 |
| 5,539,307 | A * | 7/1996 | Bischof et al. | 324/173 |
| 6,365,836 | B1 | 4/2002 | Blouin et al. | |

(Continued)

FOREIGN PATENT DOCUMENTS

| | | |
|---|---|---|
| CH | 227022 | 8/1943 |

(Continued)

OTHER PUBLICATIONS

English Translation of Japanese Published Application, JP 10-106861.*

(Continued)

*Primary Examiner* — Anh Mai
*Assistant Examiner* — Ronald Hinson
(74) *Attorney, Agent, or Firm* — Fish & Richardson P.C.

(57) ABSTRACT

An inductive component includes a closed magnetic core and a first conductor that runs at least twice through the interior of magnetic core. The first conductor is a solid conductor that includes several U-shaped pre-bent parts that are tightly connected to one another. The U-shaped pre-bent parts may be each be flat conductors. Flat sections of the flat conductors may run in planes oriented transversely to one another.

39 Claims, 5 Drawing Sheets

U.S. PATENT DOCUMENTS

| | | | |
|---|---|---|---|
| 7,280,027 | B2 | 10/2007 | Feth et al. |
| 7,400,224 | B2 | 7/2008 | Feist |
| 7,479,865 | B2 | 1/2009 | Feist et al. |
| 7,498,916 | B2 | 3/2009 | Feist et al. |
| 2006/0055496 | A1 | 3/2006 | Na et al. |
| 2006/0192649 | A1 | 8/2006 | Feth et al. |
| 2007/0202727 | A1 | 8/2007 | Feist et al. |
| 2007/0241855 | A1 | 10/2007 | Feist |
| 2007/0285911 | A1 | 12/2007 | Feist et al. |
| 2008/0117009 | A1 | 5/2008 | Feist et al. |
| 2008/0129436 | A1 | 6/2008 | Feist et al. |
| 2008/0164968 | A1 | 7/2008 | Feist et al. |
| 2009/0115559 | A1 | 5/2009 | Feist et al. |
| 2009/0152003 | A1 | 6/2009 | Feist et al. |

FOREIGN PATENT DOCUMENTS

| | | |
|---|---|---|
| CH | 290733 | 8/1953 |
| DE | 1 253 353 | 11/1967 |
| DE | 1 563 195 | 11/1969 |
| DE | 28 50 657 | 4/1982 |
| DE | 3047603 | 7/1982 |
| DE | 3318557 | 11/1984 |
| DE | 8620742 | 2/1988 |
| DE | 19604480 | 8/1997 |
| DE | 19932475 | 2/2001 |
| DE | 10223995 | 11/2003 |
| DE | 10308010 | 9/2004 |
| EP | 0258592 | 3/1988 |
| GB | 2 008 858 | 6/1979 |
| JP | 54-156754 | 10/1979 |
| JP | 60-179013 | 11/1985 |
| JP | 03-00019 | 1/1991 |
| JP | 06 302437 | 10/1994 |
| JP | 08-285897 | 11/1996 |
| JP | 09-045539 | 2/1997 |
| JP | 09-237717 | 9/1997 |
| JP | 10 106861 | 4/1998 |
| JP | 2001 274030 | 10/2001 |
| WO | WO2004/055840 | 7/2004 |
| WO | WO2004/077459 | 9/2004 |
| WO | WO2006/015589 | 2/2006 |
| WO | WO2006/039876 | 4/2006 |

OTHER PUBLICATIONS

English Translation of Japanese Published Application, JP 2001-274030.*
International Search Report for PCT/DE2005/001422.
Written Opinion for PCT/DE2005/001422.
Databook "Ferrite and Zubehor" Epcos AG, Feb. 2002, pp. 34-41.
English translation of Written Opinion for PCT/DE2005/001422.
International Search Report and Written Opinion in Application No. PCT/DE2004/000171, dated Jun. 9, 2004.
International Preliminary Report on Patentability in Application No. PCT/DE2004/000171, dated Sep. 23, 2005.
Int'l Search Report in Application No. PCT/DE2006/000231, dated Jun. 2, 2006.
English Translation of Int'l Preliminary Report on Patentability (incl. Written Opinion) in Application No. PCT/DE2006/000231, dated Sep. 11, 2007.
Action and Response History in U.S. Appl. No. 10/545,362, on Sep. 8, 2009.
Action and Response History in U.S. Appl. No. 11/816,041, on Jan. 4, 2009.
Action and Response History in U.S. Appl. No. 11/816,041, on Mar. 18, 2010.
Machine Translation of German Patent Publication No. DE8620742.
Action and Response History in U.S. Appl. No. 11/816,041, on Nov. 4, 2010.
English Translation of Notification of Reasons for Refusal in Japanese Application No. 2007-554418, dated Nov. 11, 2010.
Prosecution History in U.S. Appl. No. 11/816,041, on Feb. 10, 2011.
Translation of examination report dated Sep. 28, 2010 from corresponding application JP2007-525164.

* cited by examiner

INDUCTIVE COMPONENT FOR HIGH CURRENTS AND METHOD FOR THE PRODUCTION THEREOF

TECHNICAL FIELD

This patent application relates to an inductive component with a closed magnetic core, which is used in applications for high currents (e.g., in network filters).

BACKGROUND

A prior art inductive component is described in publications DE 2850657 C2 and CH 290733.

Typically, an inductive component that is suitable for high currents has a conductor with a large cross section. The conductor can be formed as a flexible stranded wire or a difficult-to-bend solid conductor (e.g., busbar).

SUMMARY

Described herein is an inductive component suitable for use with high currents that has high inductance and is relatively small.

The inductive component is suitable for high currents and has a closed magnetic core and a conductor that runs at least twice through the interior of the magnetic core and forms one winding of the component. The conductor comprises several tightly connected, pre-bent or angled parts of a solid conductor having high bending strength.

Two conductor parts connected to one another can be, for instance, U-shaped, wherein the leg length of the U-pieces can be different. Two conductor parts connected to one another can also each be formed as an L-piece. Connecting a U-piece to an L-piece is also provided. The conductor parts can be bent or angled at least once, twice to form a U-piece, even more than twice in one variant. One leg of the respective conductor parts can be inserted through the inside hole of the core.

High inductance values with a low overall volume can be achieved in a component suitable for high currents. The increase in inductance is proportional to the square of the number of turns per unity length.

Components that are less susceptible to short circuits can be implemented using the inductive component described herein. Compared to a flexible conductor that is composed of several wires, a solid conductor has the advantage of low impedance losses. The solid conductor has a high form stability and therefore a high mechanical strength. Conductor parts constructed from a solid conductor have the advantage that they retain a predetermined shape when connected to additional conductor parts.

A solid conductor for the inductive component may be distinguished from a flexible wire, particularly a flexible wire that can be wound around a core. The current carrying capacity of the solid conductor can be 200 A, 500 A, 1000 A or 2500 A, for example, depending on the application. A difficult-to-bend solid conductor may be distinguished from a flexible solid conductor that has a current carrying capacity of less than 150 A.

The solid conductor may be a busbar or omnibus bar with a rectangular cross section. The solid conductor can be, for instance, a copper rail or an aluminum rail. The solid conductor can also include another metal with a good electrical conductivity. The solid conductor can also be a flat conductor of punched metal, e.g., sheet metal. It is advantageous if at least one of the conductor parts tightly connected to one another has contact areas offset relative to one another in height.

The conductor parts can, for instance, be U-shaped or L-shaped flat parts. Sections that run transversely to one another in the conductor parts either lie in one plane, or in planes that form an acute angle relative to one another.

In one embodiment, the conductor can be without an insulating sheath. In another embodiment, the conductor can have an insulating sheath. The insulating sheath can be formed, for instance, by an insulating lacquer or a plastic layer.

The conductor may include several conductor parts that are tightly connected mechanically to one another by, e.g., bolting, soldering or welding. Such a configuration of the conductor facilitates the assembly for closed cores.

The connecting point between different parts of the conductor may be outside the interior of the magnetic core, e.g., above the plane in which the upper end surface of the magnetic core lies or below the plane in which the lower end surface of the magnet core lies.

In one embodiment, the magnetic core can be constructed as a homogeneously closed annular core with or without a gap. The gap can be filled with a material with a magnetic permeability different from the material of the core. In another embodiment, the magnetic core can be composed of several parts, for example, of two U-parts or E-parts. The core can also be formed from an E-shaped and a rod-shaped core part, with two closed magnetic circuits being formed. The gaps formed here can be filled with a material with a magnetic permeability different from the material of the core. An adhesive for bonding the core parts to one another can also be filled in these gaps.

The core or core part can include, for instance, of iron, metal oxides, ceramic, plastic, ferrites or other soft magnetic materials or alloys thereof. The core or the core part can be composed of iron sheets.

The magnetic core can be in several parts, the core parts each having a closed magnetic circuit and being arranged one above the other along the core axis.

Each of the pre-bent or angled parts of the conductor can be inserted through the inside hole of the magnetic core and then connected to one another outside of the inside hole of the magnetic core.

Pre-bent conductors may be combined to make a magnetic core.

With a composite core, it is possible first to bend the conductor or the parts of the conductor, wherein turns of a winding are formed. The first core part is inserted through the turns of the conductor. The first core part is then mechanically connected to a second core part. For an inductor with two windings, the second core part is inserted through the turns of an additional conductor. The two core parts with windings are then mechanically connected to one another.

The conductor may be fixed in the component such that it does not touch the core. The arrangement of the core and the conductor, or parts of the arrangement, can be fixed in the housing via, for instance, a molding compound. It is also possible to mount the core and the conductor independently of one another.

The conductor may form a winding that is wound around the magnetic core. Every turn of the conductor is assigned to a different winding plane. At the connecting point, a part of the conductor can be angled such that the transition from one winding plane to another thereby takes place. The transition from one winding plane to another can also be achieved by angled connecting pieces between the parts of the conductor.

The inductive component can be employed, for example, as a current-compensated choke in a network filter suitable for two, three or >3 current phases.

In one embodiment, more than only two different windings, each electrically connected, for instance, to one phase of a multiphase power network, can be used in the inductive component. In this case, each of the windings is formed essentially like the above-described conductor.

In one embodiment (FIG. 3F), an opening of the U-piece for a first conductor part points toward the second end surface of the core. The legs of the two U-pieces have an area of overlap and are tightly connected to one another in this area. The U-pieces are pre-bent in one variant. In another embodiment they are available as punched flat pieces.

The inductive component will be described in detail below on the basis of embodiments and the associated figures. The figures show various embodiments with schematic representations not drawn to scale. Identical or identically functioning parts are labeled with identical reference characters.

DETAILED DESCRIPTION

Figure 1:
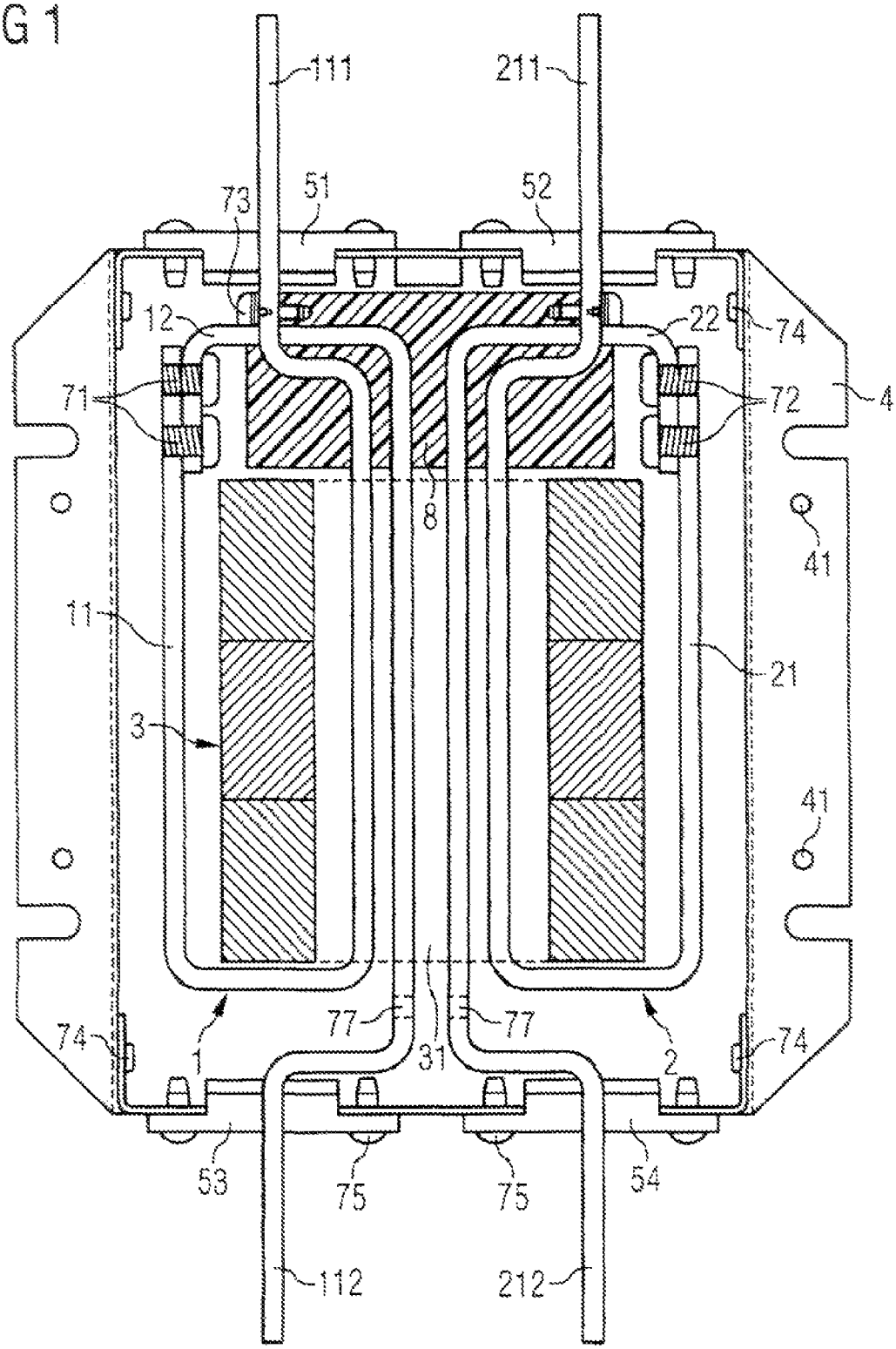
FIG. 1, the cross section of an inductive component with a housing.

FIG. 1 shows an inductive component with a magnetic core 3 and two windings that are formed by a first conductor 1 and a second conductor 2. The arrangement of magnetic core 3 and conductors 1, 2 is arranged in a housing 4 of sheet metal. First conductor 1 is composed of two pre-bent parts 11 and 12. Second conductor 2 is likewise composed of two pre-bent parts 21 and 22. The parts of the respective conductor are connected to one another, e.g., screwed together, via fastening elements 71, 72.

Figure 2:
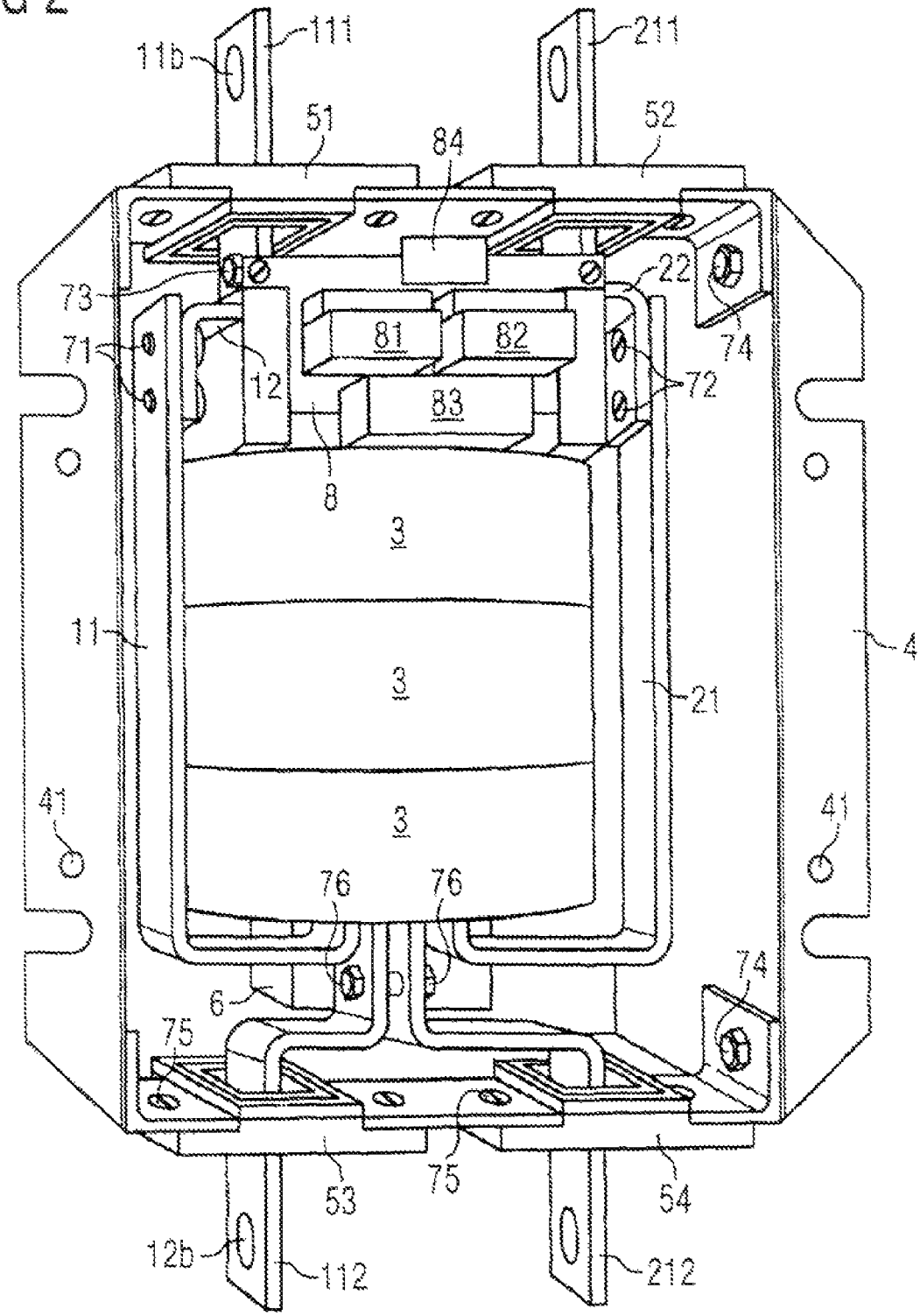
FIG. 2, a perspective view of a network filter with an inductive component.

First part 11 of first conductor 1 has two openings for receiving fastening elements 71, an opening 11*b*, visible in FIG. 2, in the area of first connector 111 of first conductor 1, as well as another opening for receiving a fastening element 73. Fastening element 73 serves to fasten a line section, not shown there, that produces the electrical connection to board 8.

First part 11 of first conductor 1 can have only one opening for receiving fastening elements, or more than two such openings, depending on the embodiment.

Second part 12 of first conductor 1 has two openings for receiving fastening elements 71, an opening 12*b*, visible in FIG. 2, in the area of second connector 112 of first conductor 1, as well as another opening 77 for receiving a fastening element 76 (see FIG. 2). Fastening element 76 serves to fasten a line section, not shown here, that produces the electrical connection to capacitor 6 in FIG. 2.

First conductor 1 runs twice through inside hole 31 of closed magnetic core 3. Second conductor 2 likewise runs twice through inside hole 31 of magnetic core 3. Second conductor 2 is constructed similarly to first conductor 1.

Figure 3A:
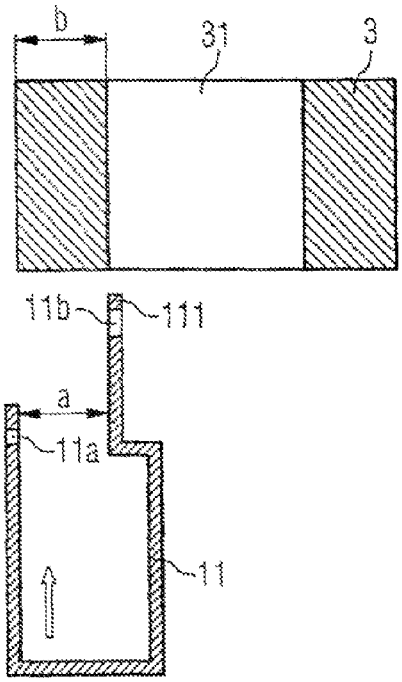
FIGS. 3A-3F, process steps in the assembly of a conductor.
Figure 3B:
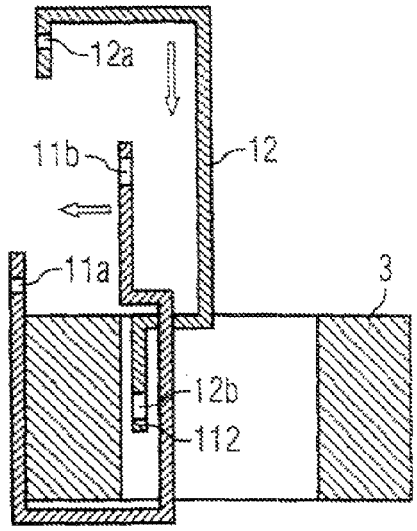

Parts 11, 12 of conductor 1 are constructed such that they can easily be inserted through magnetic core 3. As shown in FIG. 3A, the decomposition of conductor 1 into parts 11, 12 can be undertaken, for instance, such that the distance a between the legs of U-shaped part 11 is not less than the wall thickness b of the magnetic core. After insertion through the core, parts 11 and 12 are mechanically connected to one another and thus fixed relative to the core such that their connection point is arranged above the plane in which the upper end surface of magnetic core 3 lies. Therefore, the arrangement can be designed to save space, particularly in the direction transverse to the axis of magnetic core 3. It is advantageous if the connecting point between parts 11, 12 faces away from inside hole 31 of magnetic core 3.

Depending on the number of turns provided, conductor 1 can decomposed into more than only two parts. It is advantageous to form the parts with U-shaped areas, with the (e.g., shorted) legs of different U-parts overlapping one another. The core can be introduced between the legs of a U-part. Parts 11, 12 of first conductor 1 and parts 21, 22 of second conductor 2 are angled to the outside such that the distance between first component terminals 111, 211 and the distance between second component terminals 112, 212 is the same.

In one implementation, only parts that each form less than a full turn are used. They may form a half or three-quarter turn.

First conductor 1 is mounted in housing 4 and electrically insulated from it via insulating inserts 51, 53. Second conductor 2 is mounted in housing 4 and electrically insulated from it via insulating inserts 52, 54. Inserts 51-54 are mounted in the housing via fastening elements 74, 75.

Magnetic core 3 is an annular cores with an inside holed 31. Magnetic core 3 is in three parts here, the core parts each having a closed magnetic circuit and being arranged one above another along the core axis. Magnetic core 3 is mounted in housing 4 such that it does not contact the turns of conductors 1, 2. In another embodiment, the turns can contact the core if the core consists of an electrically insulating material or the winding is electrically insulated from the core.

Housing 4 encloses magnetic core 3, first conductor 1 apart from its terminal 111, 112 as well as second conductor 2 apart from its terminals 211, 212. Housing 4 has openings 41 for receiving additional fastening elements, with which the entire component can be mounted on, for instance, a panel or in a sheet metal cabinet. Openings 41 can also be rivet holes for a housing lid.

FIG. 2 shows the perspective view of a network filter with an inductive component of the type described herein. In addition to the inductive component (elements 1, 2, 3), capacitors 6 and 81-83 electrically connected thereto are arranged inside housing 4. Capacitors 81-83 are mounted on a circuit board 8. Circuit board 8 is connected with low inductance to housing 4 via a copper strip 84.

FIGS. 3A-3F show process steps in the assembly of a conductor on the magnetic core.

Figure 3C:
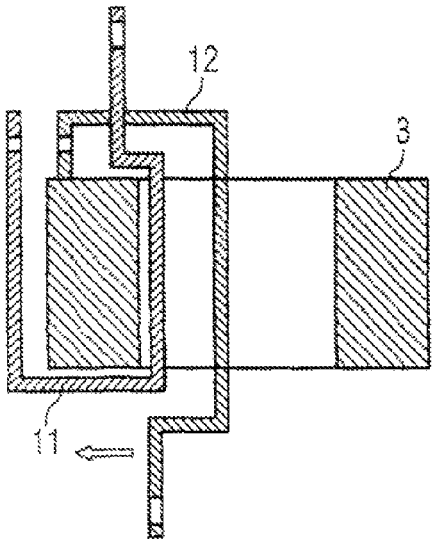
Figure 3D:
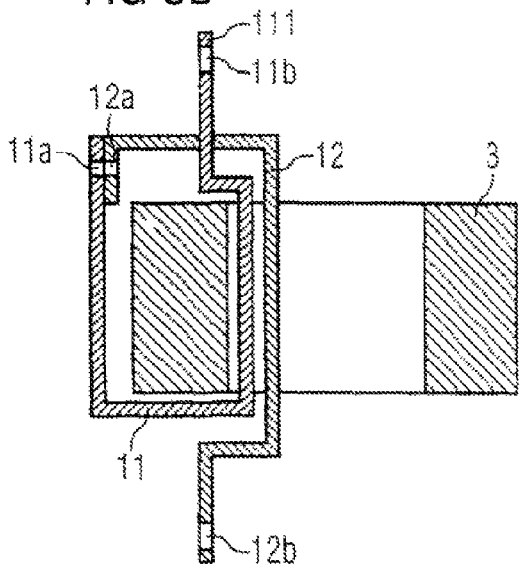
Figure 3E:
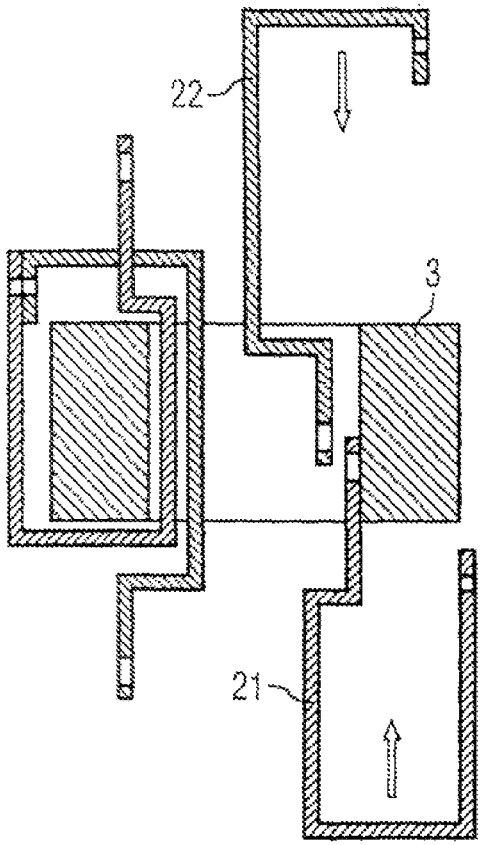
Figure 3F:
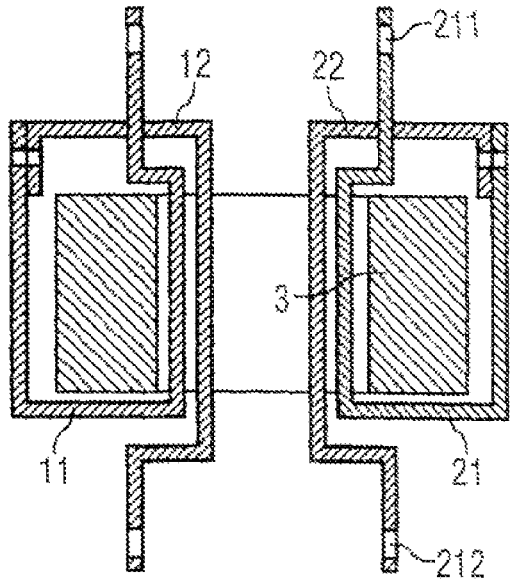

First, closed magnetic core 3 and parts 11, 12 of first conductor 1, a well as the parts 21, 22 of second conductor 2 are prepared. Parts 11, 12, 21, 22 of first and second conductors 1, 2 are formed in a U-shape with an angled longer leg. First part 11 of first conductor 1, as well as first part 21 of second conductor 2, is inserted from below across the wall of magnetic core 3 (FIGS. 3A, 3B, 3E) and oriented such that the distance from magnetic core 3 is maintained, and is fixed in the housing of the component, not shown here, via inserts 51, 52 shown in FIG. 2, and via, for instance, leadthroughs (FIGS. 3C, 3F). Second part 12 of first conductor 1 and second part 22 of second conductor 2 are inserted from above into inside hole 31 of magnetic core 3 (FIGS. 3B, 3E) and oriented relative to the core and parts 11, 21 such that openings 11*a*, 12*a* of parts 11, 12 match one another and the distance from parts 11, 12 match one another (FIGS. 3C, 3F) and the distance from magnetic core 3 is maintained, and fixed in the housing of the component via inserts 53, 54 shown in FIG. 2, and via, for instance, lead-throughs (FIGS. 3D, 3F). Part 11 is tightly connected to part 12 via, for instance, fastening elements. Part 21 is tightly connected to part 22 via, for instance, fastening elements. The connecting of the parts to one another can take place before the fixation of these parts in the housing. The connecting of the parts to one another can also take place after the fixation of these parts in the housing.

In one embodiment, the core can be fixed in the housing before the insertion of parts 11, 12, 21, 22. In another embodiment, the core can be fixed in the housing only after the orientation and fixation of parts 11, 12, 21, 22.

In the assembly shown in FIGS. 3A-3F, first conductor 1 is assembled first. Second conductor 2 is assembled in the same manner after assembly of first conductor 1.

First parts 11, 21 can also be inserted or mounted in a single step, with second parts 12, 22 being inserted and mounted in an additional step.

The order of the process can in principle be selected arbitrarily.

Figure 4:
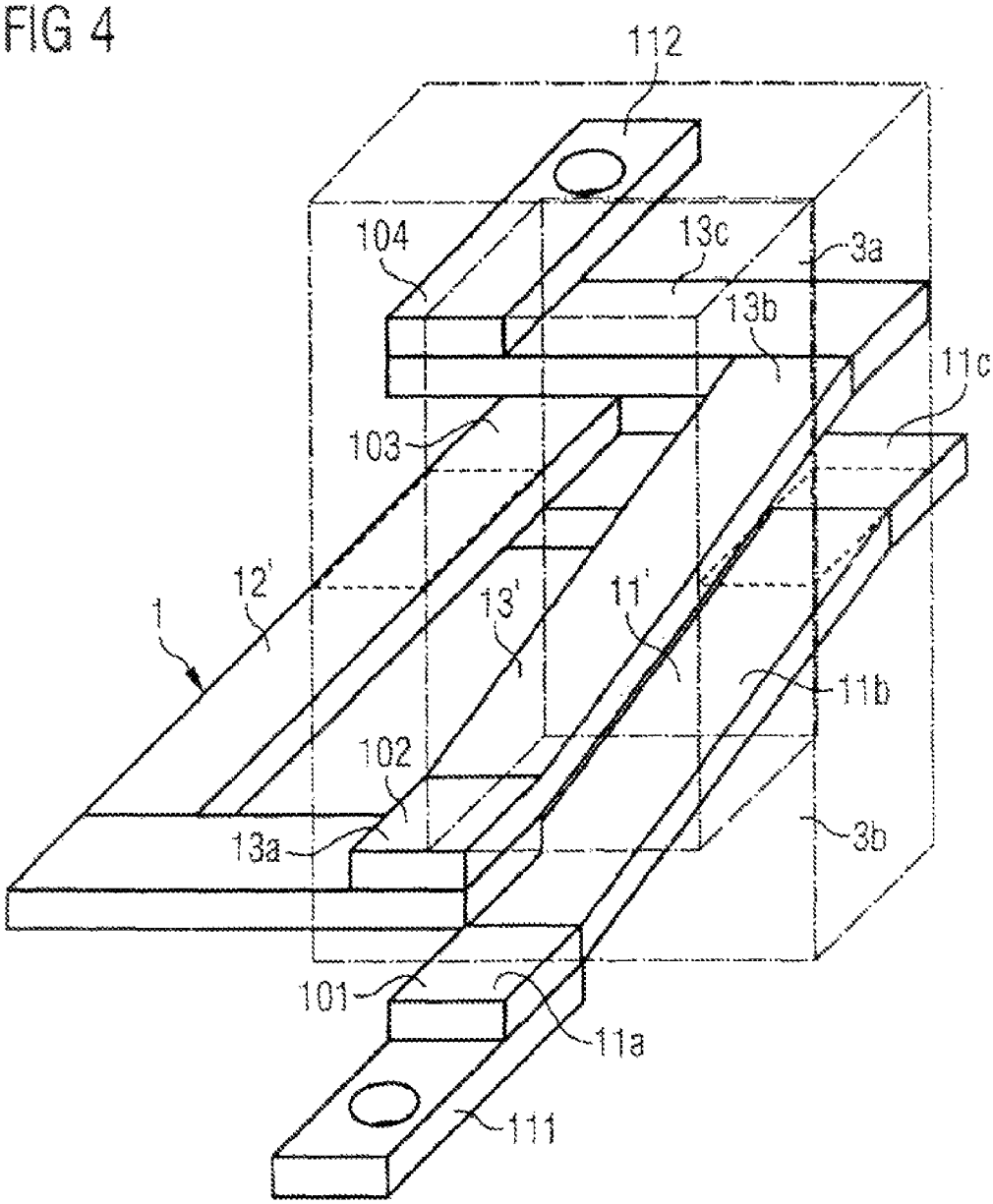
FIG. 4, a perspective view of an inductive component with a winding that is composed of L-shaped flat conductor parts.

FIG. 4 shows an inductive component with a winding that is composed of tightly connected L-shaped flat conductor parts 11', 12', 13'. First flat conductor parts 11' and 13' are bent such that they each have a section 11*b*, 13*b* running at an inclination. Sections 11*b*, 13*b* respectively connect sections 11*a* and 11*c*, 13*a* and 13*c*, each of which is arranged in different winding planes. Therefore, the transition between the two winding planes is effected by the inclined section of the L-piece or by assembly with a height offset (of the connecting areas).

Superimposed areas of flat conductor parts 11', 12' and 13' are associated with a connecting area 101, 102, 103, 104. Connecting areas 101 and 103, 102 and 103, 102 and 104 of two flat conductor parts are respectively arranged along a diagonal. The flat conductor parts are tightly connected in the connecting areas via, for example, welding, a threaded connection or soldering.

First flat conductor parts 11' and 13' are connected to one another via a second flat conductor part 12'. Second conductor part 12' has no bend and is arranged in one winding plane. In principle, it can also be bent like parts 11' and 13'.

In one embodiment, the winding can comprise more than only two first parts 11', 13' and only one second part 12'. Although only one winding is shown in FIG. 4, N windings can be provided around the same core to form magnetically coupled inductors for N current phases, where N=2, 3, . . . .

Conductor part 11' is tightly connected to terminal piece 111, and conductor part 13' is tightly connected to terminal piece 112. The terminal pieces may each have at least one opening for receiving a fastening element.

The L-pieces in FIG. 4 can be replaced by U-pieces in one embodiment. First U-part, for instance, is bent such that its connecting piece runs at an inclination. The second U-part can lie in one winding plane, or can be bent as well. The connecting points of two U pieces may face end surfaces of the core.

The magnetic core of FIG. 4 is a closed core that is composed of two U-pieces connected to one another. The magnetic core can also be a single piece, however.

The scope of protection is not limited to the example presented or to specific materials. Refinements regarding, for example, the design of the connecting point between different parts of the conductor or regarding the mounting of parts of the arrangement of core and conductor piece are provided.

The technical teaching in connection with pre-bent conductor parts 11, 12, 21, 22 (FIGS. 1-3F) is immediately applicable, for instance, to correspondingly angled punched flat conductor parts. In this case, each bend of conductor part 11, 12, 21, 22 is replaced by and angle of the flat conductor.

What is claimed is:

1. An inductive component comprising:

a closed magnetic core; and a first conductor that runs at least twice through an interior of the closed magnetic core, the first conductor comprising a side that faces an exterior of the closed magnetic core, the side of the first conductor having a width that exceeds a thickness of the first conductor;

a second conductor that runs at least twice through an interior of the closed magnetic core, the second conductor comprising a side that faces an exterior of the closed magnetic core, the side of the second conductor having a width that exceeds a thickness of the second conductor;

wherein the first conductor comprises U-shaped parts that are interconnected and that are bent; and wherein a point at which the U-shaped parts are interconnected is outside of a space between planes that contain end surfaces of the closed magnetic core.

2. The inductive component of claim 1, wherein the U-shaped parts comprise conductors that have flat sections; and wherein the flat sections run in planes that are oriented transversely to each other.

3. An inductive component comprising:

a closed magnetic core; and a first conductor that runs at least twice through an interior of the closed magnetic core;

wherein the first conductor comprises L-shaped parts comprising sections that are flat and that are interconnected;

wherein at least one L-shaped part comprises flat sections and an inclined section, the flat sections being in different planes and the inclined section being at an inclination relative to the different planes;

wherein at least two of the L shaped first parts comprise flat sections that are in different winding planes, each of the flat sections in different winding planes being attached to a different part; and wherein an L shaped part between the at least two L-shaped parts is not at an inclination relative to the flat sections of the at least two L-shaped parts.

4. The inductive component of claim 3, wherein flat sections of at least two of the L-shaped parts are in different winding planes.

5. The inductive component of claim 4, wherein the L-shaped parts are punched.

6. The inductive component of claim 3, wherein the first conductor comprises a busbar.

7. The inductive component of claim 3, wherein a current capacity of the first conductor is at least 150 A.

8. The inductive component of claim 7, wherein the current capacity of the first conductor is at least 500 A.

9. The inductive component of claim 3, wherein at least some of the L-shaped parts are mechanically interconnected.

10. The inductive component of claim 9, wherein a connection point at which the at least some L-shaped parts connect is outside of a space between two planes that contain end surfaces of the closed magnetic core.

11. The inductive component of claim 10, wherein the first conductor comprises turns, each of the turns being in a separate winding plane; and wherein a transition between two winding planes is in an area of the connection point.

12. The inductive component of claim 1, wherein different parts of the first conductor are connected via fastening elements.

13. The inductive component of claim 1, wherein different parts of the first conductor are connected via weld, solder or rivet.

14. The inductive component of claim 1, wherein the first conductor comprises terminals that emerge from different surfaces of the closed magnetic core.

15. The inductive component of claim 12, wherein the first conductor has openings for receiving the fastening elements.

16. The inductive component of claim 1, further comprising:

a housing that encloses the closed magnetic core and at least part of the first conductor.

17. The inductive component of claim 16, wherein the closed magnetic core and the first conductor are held in the housing by a molding compound.

18. The inductive component of claim 1, wherein the second conductor comprises U-shaped parts that are interconnected or L-shaped parts that are interconnected.

19. The inductive component of claim 1, wherein the closed magnetic core comprises two U-shaped parts or two E-shaped parts that bound a center axis of the closed magnetic core.

20. A method of producing an inductive component, comprising:

A) inserting a U-shaped first part of a first conductor through a hole of a closed magnetic core;

B) inserting a second part of the first conductor through the hole of the closed magnetic core, the second part of the first conductor having at least two angles;

C) orienting the first and second parts of the first conductor relative to the closed magnetic core and to each other such that areas of the first and second parts overlap; and D) connecting the first and second parts to each other mechanically at an area of overlap, wherein a point at which the first and second parts connect is outside of a space between planes that contain end surfaces of the closed magnetic core;

wherein the first conductor comprises a side that faces an exterior of the closed magnetic core, the side having a width that exceeds a thickness of the first conductor; and E) inserting a second conductor through a hole of the closed magnetic core so that the second conductor runs at least twice through an interior of the closed magnetic core, the second conductor comprising a side that faces an exterior of the closed magnetic core, the side of the second conductor having a width that exceeds a thickness of the second conductor.

21. A method of producing an inductive component comprising:

A) inserting, through a hole of a closed magnetic core, a first part of a first conductor, the first part being angled or bent;

B) orienting the first part and a second part of the first conductor relative to the closed magnetic core and to each other such that areas of the first and second parts overlap, the second part being angled or bent;

C) connecting the first and second parts to each other at an area of overlap, wherein a point at which the first and second parts connect is outside of a space between planes that contain end surfaces of the closed magnetic core;

wherein the first conductor comprises a side that faces an exterior of the closed magnetic core, the side having a width that exceeds a thickness of the first conductor; and D) inserting a second conductor through a hole of the closed magnetic core so that the second conductor runs at least twice through an interior of the closed magnetic core, the second conductor comprising a side that faces an exterior of the closed magnetic core, the side of the second conductor having a width that exceeds a thickness of the second conductor.

22. The method of claim 21, further comprising:

inserting the second part through a hole of the closed magnetic core.

23. The method of claim 21, wherein at least one of the first part and the second part is L-shaped.

24. The method of claim 20, wherein the first part and the second part are fixed in a housing.

25. The method of claim 24, wherein inserting the second conductor comprises:

i) inserting a U-shaped first part of the second conductor through a hole of the closed magnetic core;

ii) inserting a second part of the second conductor through the hole of the closed magnetic core, the second part having at least two angles;

iii) orienting the first and second parts of the second conductor relative to the closed magnetic core and each other such that areas of the first and second parts of the second conductor overlap; and iv) connecting the first and second parts of the second conductor to each other mechanically at an area of overlap, the areas that overlap being in the housing.

26. The method of claim 25, wherein A) and i) are performed simultaneously;

wherein B) and iii) are performed simultaneously; and wherein C) and iv) are performed simultaneously.

27. The inductive component of claim 1, wherein the first conductor comprises a busbar.

28. The inductive component of claim 1, wherein a current capacity of the first conductor is at least 150 A.

29. The inductive component of claim 28, wherein the current capacity of the first conductor is at least 500 A.

30. The inductive component of claim 1, wherein the U-shaped parts are mechanically interconnected.

31. The inductive component of claim 1, wherein the first conductor comprises turns, each of the turns being in a separate winding plane; and wherein a transition between two winding planes is in an area of the connection point.

32. The inductive component of claim 3, wherein different parts of the first conductor are connected via fastening elements.

33. The inductive component of claim 3, wherein different parts of the first conductor are connected via weld, solder or rivet.

34. The inductive component of claim 3, wherein the first conductor comprises terminals that emerge from different surfaces of the closed magnetic core.

35. The inductive component of claim 32, wherein the first conductor has openings for receiving the fastening elements.

36. The inductive component of claim 3, further comprising:

a housing that encloses the closed magnetic core and at least part of the first conductor.

37. The inductive component of claim 36, wherein the closed magnetic core and the first conductor are held in the housing by a molding compound.

38. The inductive component of claim 3, further comprising:

at least one second conductor that runs at least twice through an interior of the closed magnetic core;

wherein the second conductor comprises U-shaped parts that are interconnected or L-shaped parts that are interconnected.

39. The inductive component of claim 3, wherein the closed magnetic core comprises two U-shaped parts or two E-shaped parts that bound a center axis of the closed magnetic core.

* * * * *

UNITED STATES PATENT AND TRADEMARK OFFICE

CERTIFICATE OF CORRECTION

PATENT NO. : 8,063,728 B2
APPLICATION NO. : 11/573616
DATED : November 22, 2011
INVENTOR(S) : Roman Brunel, Josef Feth and Gerd Riedel It is certified that error appears in the above-identified patent and that said Letters Patent is hereby corrected as shown below:

Title Page, Item [54] and Column 1, Lines 1-4, Title;
Delete "INDUCTIVE COMPONENT FOR HIGH CURRENTS AND METHOD FOR THE PRODUCTION THEREOF" and Insert -- INDUCTIVE COMPONENT AND METHOD FOR THE PRODUCTION THEREOF --

Title Page, Item [57] Abstract, Line 6;
After "each" Delete "be"

Column 6, Claim 3, Line 39;
Delete "L shaped first" and Insert -- L-shaped --

Column 6, Claim 3, Line 43;
Delete "L shaped" and Insert -- L-shaped --

Signed and Sealed this
Twenty-eighth Day of August, 2012

David J. Kappos

David J. Kappos
*Director of the United States Patent and Trademark Office*